US009857141B2

(12) United States Patent
Spurlock

(10) Patent No.: US 9,857,141 B2
(45) **Date of Patent: *Jan. 2, 2018**

(54) PAINTBALL DRIVE SYSTEM OF A PAINTBALL LOADER

(71) Applicant: G.I Sportz, Inc., St. Laurent (CA)

(72) Inventor: Michael S. Spurlock, Tainan (TW)

(73) Assignee: GI Sportz, Inc., Quebec (CA)

( * ) Notice: Subject to any disclaimer, the term of this patent is extended or adjusted under 35 U.S.C. 154(b) by 66 days.

This patent is subject to a terminal disclaimer.

(21) Appl. No.: 15/046,816

(22) Filed: Feb. 18, 2016

(65) Prior Publication Data

US 2016/0161210 A1 Jun. 9, 2016

Related U.S. Application Data

(63) Continuation of application No. 14/285,816, filed on May 23, 2014.

(51) Int. Cl.
*F41B 11/53* (2013.01)
*F41B 11/71* (2013.01)

(52) U.S. Cl.
CPC ..... *F41B 11/53* (2013.01); *F41B 11/71* (2013.01)

(58) Field of Classification Search
CPC ..... F41B 11/53; F41B 11/71
See application file for complete search history.

(56) References Cited

U.S. PATENT DOCUMENTS

| | | | | |
|---|---|---|---|---|
| 5,816,232 | A * | 10/1998 | Bell | F41B 11/53 124/48 |
| 7,854,220 | B1 * | 12/2010 | Neumaster | F41B 11/53 124/51.1 |
| 8,047,190 | B2 * | 11/2011 | Kaakkola | F41B 11/57 124/1 |
| 2009/0178659 | A1 * | 7/2009 | Spicer | F41B 11/57 124/51.1 |
| 2010/0126485 | A1 * | 5/2010 | Neumaster | F41B 11/57 124/51.1 |

* cited by examiner

*Primary Examiner* — Gene Kim
*Assistant Examiner* — Jeffrey Vanderveen
(74) *Attorney, Agent, or Firm* — Craig R. Rogers; Simple IP Law, P.C.

(57) ABSTRACT

A loader and drive system are provided. The loader is preferably configured to house a quantity of projectiles (such as paintballs) in a chamber and supply the quantity of projectiles from the chamber to an attached pneumatic gun when in operation. The loader preferably includes an outlet configured to supply projectiles from the chamber to the pneumatic gun when the loader is operatively connected to the pneumatic gun. A drive system may be arranged in the loader and include a non-rotating cone arranged above the outlet and having an opening in a side thereof to provide an entrance. A way is arranged configured to direct projectiles into the outlet from the chamber through the entrance. A cover may be connected to the non-rotating cone and have an arm that directs projectiles into the entrance. A driving ring may surround the non-rotating cone and rotate around the non-rotating cone. The driving ring urges projectiles from the chamber into the way and toward the outlet during operation of the loader.

20 Claims, 7 Drawing Sheets

PAINTBALL DRIVE SYSTEM OF A PAINTBALL LOADER

PRIORITY CLAIM

This application is a continuation of, and claims priority from, U.S. patent application Ser. No. 14/285,816, filed May 23, 2014, now U.S. U.S. Pat. No. 9,297,605, the contents of which are incorporated herein by reference in their entirety.

BACKGROUND OF THE INVENTION

Field of the Invention

The present invention relates to a paintball drive system, and more particularly, to a paintball drive system of a paintball loader.

Descriptions of Related Art

Paintball guns typically use a paintball loader to feed paintballs into the gun so as to permit them to shoot continuously. The paintballs are ejected from the paintball gun using pressurized air which is provided by a high-pressure bottle. Generally, the paintball loader is attached on the top of the paintball gun and the paintballs are fed into the paintball gun one by one by a drive system in the paintball loader. In conventional loaders, the drive system comprises a disk with an inclined ramp and at least one plate located on the ramp. The disk is driven by a motor and the paintballs are shifted by the plate toward a passage, and the paintballs travel through the passage and enter into the gun one by one. Paintballs generally have a flexible and thin shell that is filled with paint. Unfortunately, paintballs may not travel through the loader as expected and/or the paintball shell may be broken during movement of the paintballs. Paintballs becoming jammed within the loader is a major problem for the players.

The present inventive concepts provide a paintball loader, and a paintball drive system of a paintball loader, that eliminate the shortcomings of the conventional art.

SUMMARY OF THE INVENTION

The present inventive concepts relate to a paintball loader and a paintball drive system of a paintball loader. The paintball drive system may be located in a paintball loader which has a top casing and a bottom casing. The paintball drive system comprises a board having a hole, and an inclined ramp that extends from the periphery of the hole. A power unit is connected to one end of the board. A base is located at the underside of the board and located corresponding to the hole. A room or chamber is formed in the top of the base and a cone extends from the top of the base. An outlet is defined through a center of the cone and a paintball way is formed along the periphery of the cone and communicates with the room. The cone has an entrance which communicates with the outlet and the paintball way. A cover is engaged with the outlet. A gear ring is located in the room of the base and has teeth defined in the outside thereof. The power unit is engaged with the teeth to rotate the gear ring. A friction ring is located at the inside of the gear ring so as to push the paintballs toward the entrance. A driving ring is connected to the gear ring and rotated by the gear ring so as to move the paintballs.

Preferably, the board has two wings respectively extending from two sides thereof, and each of the two wings has an engaging edge which is connected to the top and bottom casings.

Preferably, the friction ring is made of multiple duraometer silicone and has multiple protrusions extending at equal distance from the inner periphery thereof so as to move the paintballs.

Preferably, the power unit has a power source and at least one transmission member. The power source has an output shaft which rotates the at least one transmission member which is engaged with the teeth of the gear ring so as to rotate the gear ring.

Preferably, a first sensor is located beneath the inclined ramp and detects the presence or absence of paintballs in the paintball loader.

Preferably, the power unit has a first gear and a second gear whose teeth are less than those of the first gear. The output shaft of the power source is engaged with the first gear which is engaged with the second gear. The second gear is engaged with the teeth of the gear ring.

Preferably, a second sensor is located at the outlet of the base and detects paintballs passing through the outlet.

Preferably, the first and second sensors are electrically connected to each other.

Preferably, a non-touch sensor is connected to a root portion of the paintball loader. The non-touch sensor activates or shuts off electric power by way of non-physical touch.

Preferably, the first and second sensors are infrared sensors.

The primary object of the present inventive concepts is to provide a paintball loader and a paintball drive system of a paintball loader, wherein paintballs (or other projectiles) are smoothly fed into the paintball gun and are not broken during feeding. In other words, the loader and drive system of the present inventive concepts preferably eliminate jamming and breaking of paintballs within the loader and drive system.

The present inventive concepts will become more readily apparent from the following description when taken in connection with the accompanying drawings which show, for purposes of illustration only, a preferred embodiment.

DETAILED DESCRIPTION OF THE PREFERRED EMBODIMENT

Figure 1:
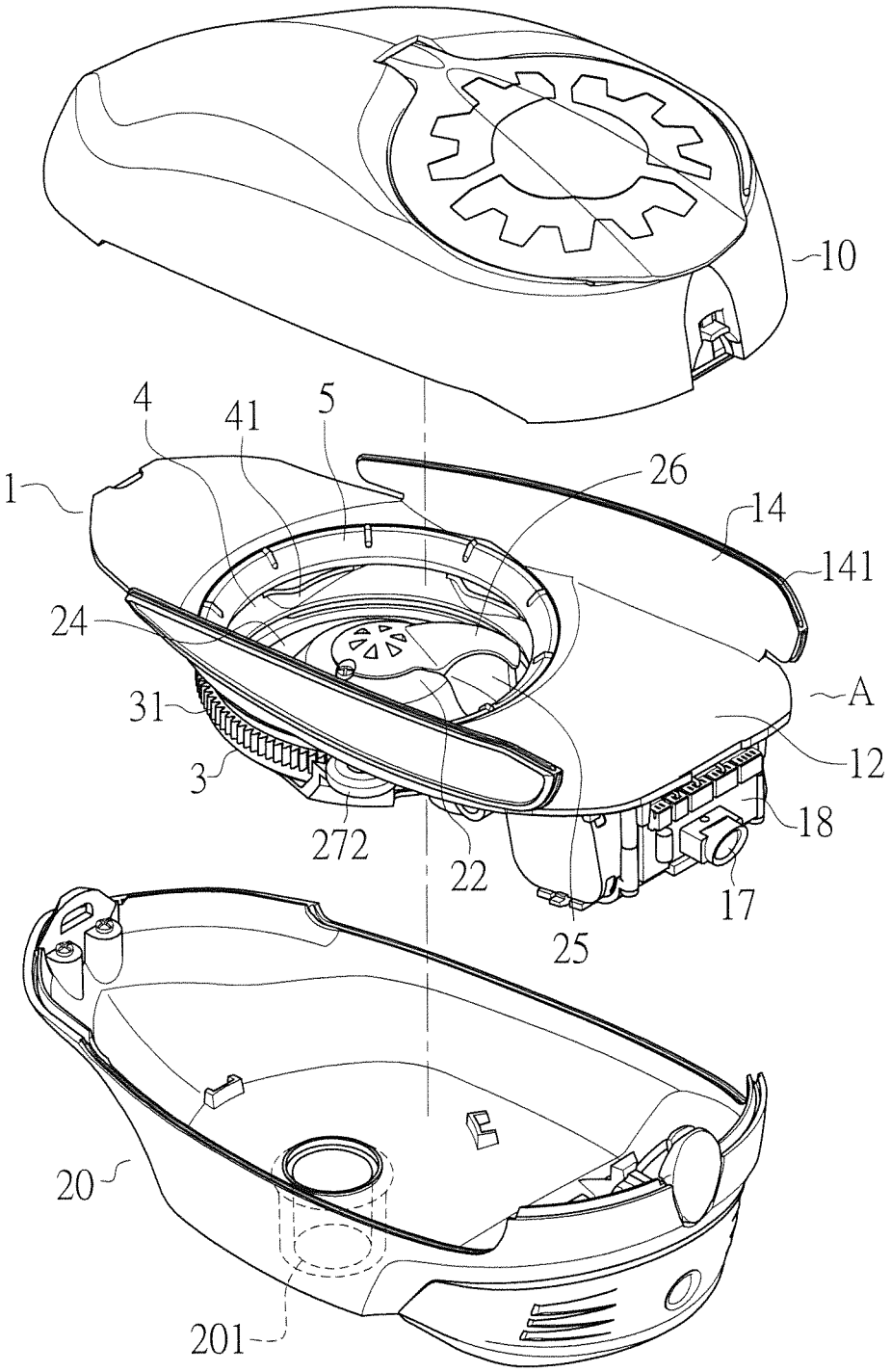
FIG. 1 is an exploded view of a paintball loader and drive system according to the present inventive concepts.
Figure 2:
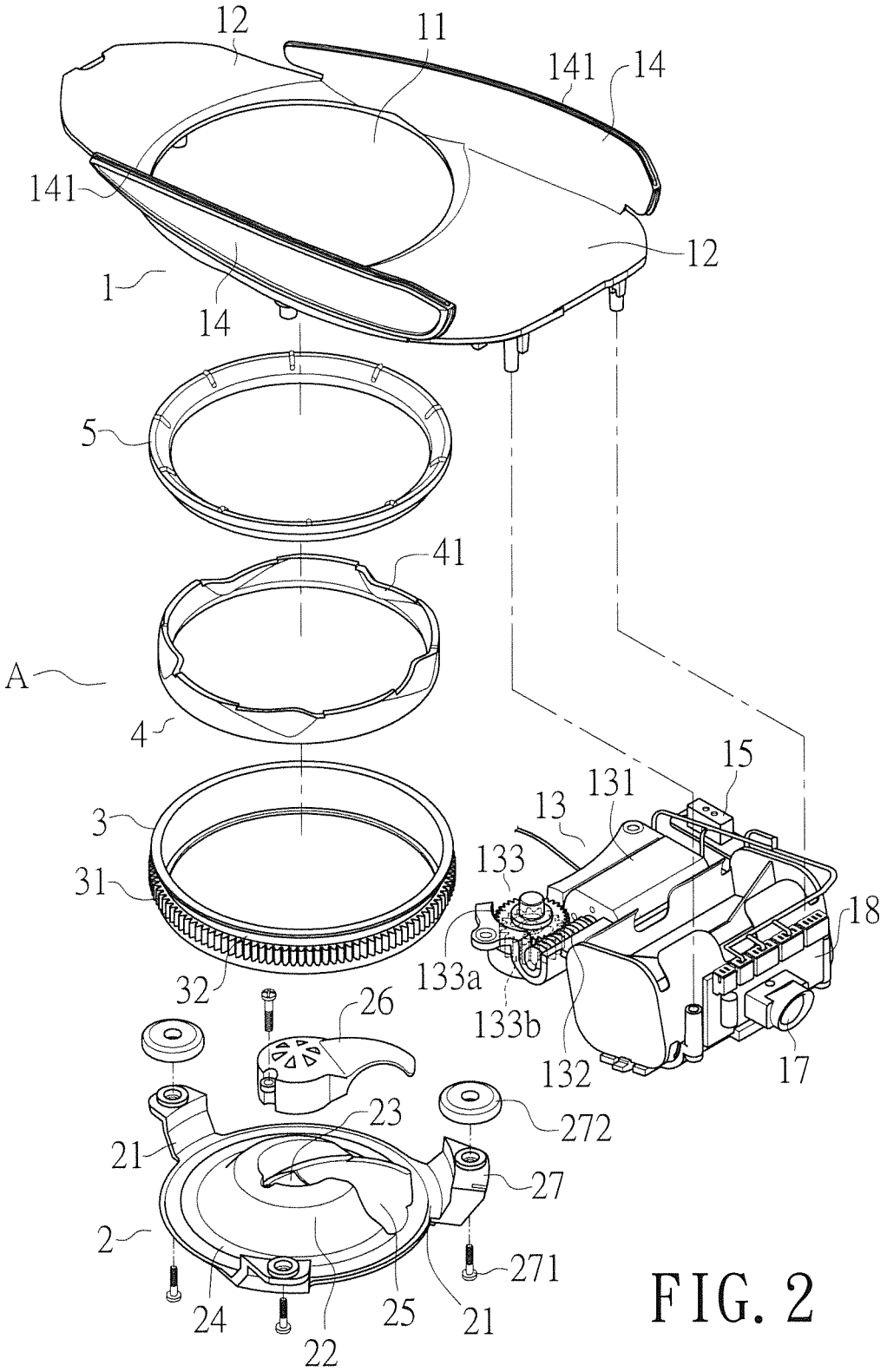
FIG. 2 is an exploded view of the paintball drive system of the paintball loader of FIG. 1.

Referring initially to FIGS. 1 and 2, a paintball loader according to the present inventive concepts may comprise a top casing 10 and a bottom casing 20, and a paintball drive system "A" may be arranged between the top and bottom casings 10, 20, respectively.

The paintball drive system "A" of the present inventive concepts may comprise a board (or floorboard) 1 having a hole 11 defined therethrough, and an inclined ramp 12 extending from the periphery of the hole 11. A power unit 13 may be connected to one end of the board 1.

A base 2 may be arranged at the underside of the board 1 and positioned at a location corresponding to the hole 11. A room or chamber 21 may formed in the top of the base 2. A cone 22 (that is non-rotatable with respect to the base 2 and loader casings 10, 20) extends from the top of the base 2, and an outlet 23 is defined through the center of the cone 22. A paintball way 24 may be formed along the periphery of the cone 22 to communicate with the room 21. The cone 22 may further include an entrance 25 which communicates with the outlet 23 and the paintball way 24. A cover 26 may be engaged with the outlet 23. Multiple connection members 27 may be provided which extend from the base 2 so as to be connected with the board 1 by locking members 271. Each of the connection members 27 may include a roller 272 connected thereto. These rollers 272 are located beneath the board 1.

A gear ring 3 may be located in the room 21 of the base 2 and have teeth 31 defined in the outside thereof. The power unit 13 is preferably engaged with the teeth 31 to rotate the gear ring 3. An annular groove 32 may be defined in the outside of the gear ring 3 and located above the teeth 31, and the rollers 272 may move along the annular groove 32.

A friction ring 4 may be located at the inside of the gear ring 3 so as to push paintballs in the chamber 21 toward the entrance 25. Multiple protrusions 41 may be arranged at equal distances from one another and may extend inwardly a small distance from the inner periphery thereof.

A driving ring 5 may be connected to the gear ring 3 and may be rotated by the gear ring 3 arranged in the hole 11 to move the paintballs.

As shown in FIGS. 1 to 7, the board 1 may have two wings 14, each extending from a respective one of the two sides thereof, and each of the two wings 14 may have an engaging edge 141 which is connected to the top casing 10 and the bottom casing 20. The bottom casing 20 may include a path 201 which is in communication with the outlet 23. The top and bottom casings 10, 20, respectively, are preferably easily connected to the engaging edge 141 of the board 1, and preferably do not require any tool to make the connection or to be disconnected from each other.

When in use, the paintballs located in the room or chamber between the board 1 and the top casing 10 enter the hole 11 and are moved toward the paintball way 24. The paintballs in the base 2 contact a non-action surface of the paintball way 24 and are moved by friction force along a guiding face of the friction ring 4 and the driving ring 5. Paintballs loaded into the loader are arranged in the room between the cone 22, the friction ring 4 and the paintball way 24. The paintballs are detected by the first sensor 15 which is electrically connected with a control circuit 18. The control circuit 18 activates a power source 131 of the power unit 13, and an output shaft 132 of the power source 131 drives at least one transmission member 133 which is engaged with the teeth 31 of the gear ring 3 so that the gear ring 3 is rotated. The motor of the control circuit 18 controls the revolutions per minute (R.P.M.) of the power source. In one preferable embodiment, the power unit 13 has a first gear 133*a* and a second gear 133*b* whose teeth are less than those of the first gear 133*a*. The output shaft 132 of the power source 131 is engaged with the first gear 133*a* which is engaged with the second gear 133*b*, and the second gear 133*b* is engaged with the teeth 31 of the gear ring 3. By this arrangement, a gear reduction unit may be provided and utilized.

When the gear ring 3 rotates, the friction ring 4 and the driving ring 5 are rotated. The paintballs are driven by friction force provided by the friction ring 4 and the driving ring 5 so as to roll along the paintball way 24.

When the gear ring 3 rotates clockwise, each of the paintballs rolls along a fixed surface (provided by the paintball way 24), and a movable surface (provided by the friction ring 4 or the driving ring 5). The paintballs are moved by the friction ring 4 toward the cone 22 and reach the cover 26. The cover 26 may include an arm that guides the paintballs to the outlet 23 so that the paintballs enter into the path 201. When the paintballs reach the cover 26 and the entrance 25, because the entrance 25 and the paintball way 24 are two different faces joined together, the paintballs may be temporarily stopped at the interface between the entrance 25 and the paintball way 24, and then forced into the path 201 by the following paintballs.

Figure 5:
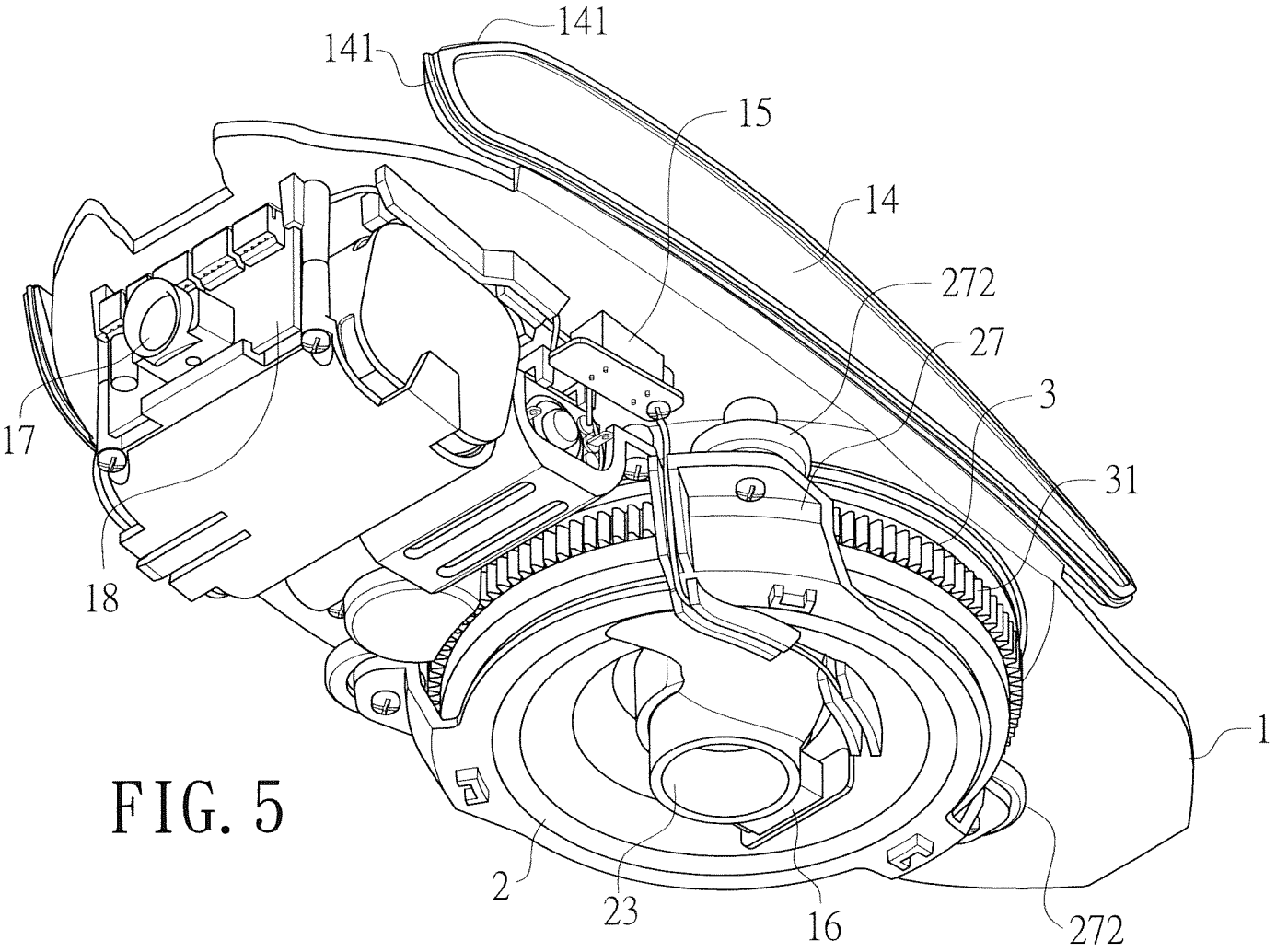
FIG. 5 is a bottom perspective view of the drive system of the paintball loader of FIG. 1.
Figure 6:
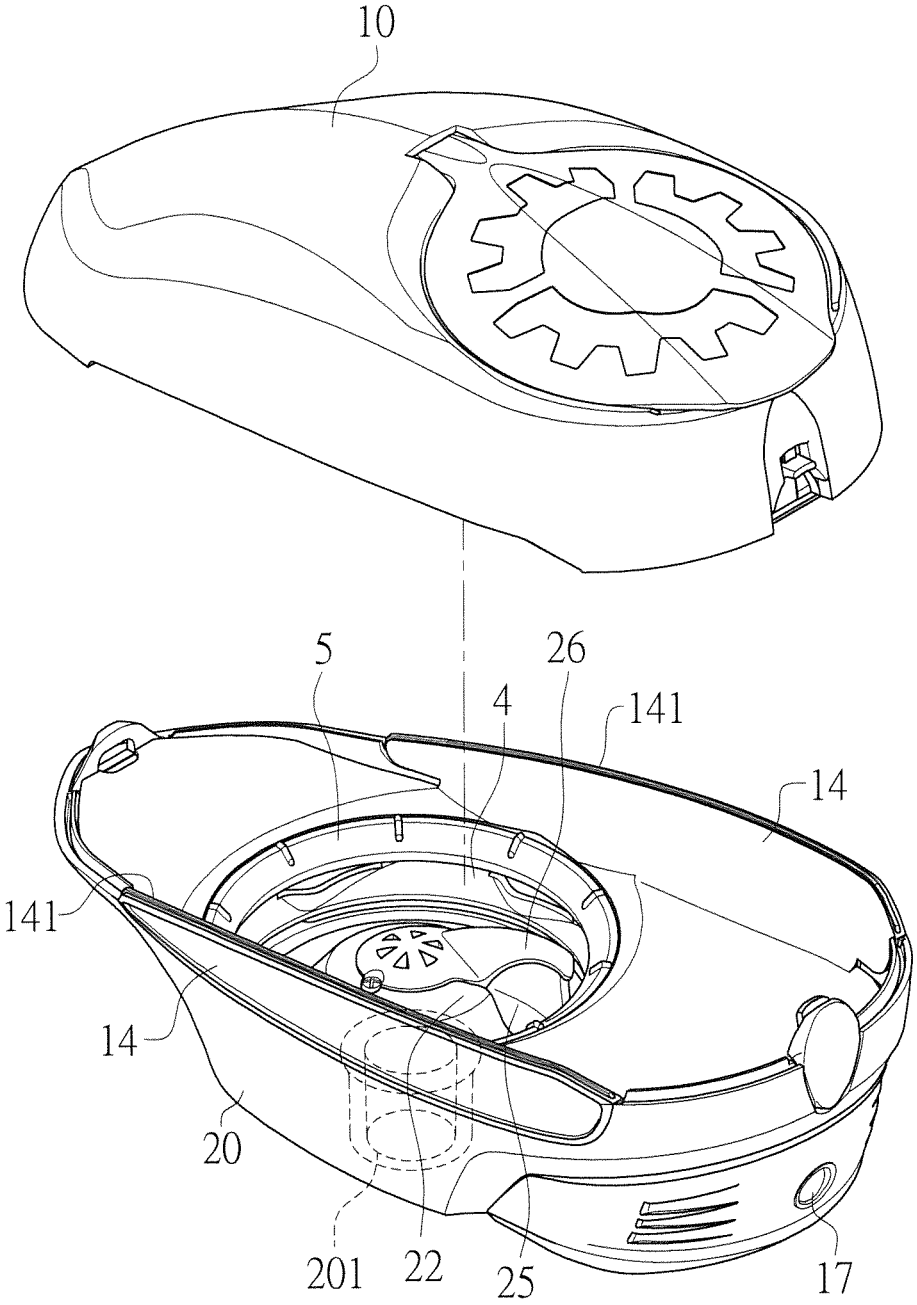
FIG. 6 is a top perspective view showing the top casing and bottom casing of the loader FIG. 1 separated from each other.
Figure 7:
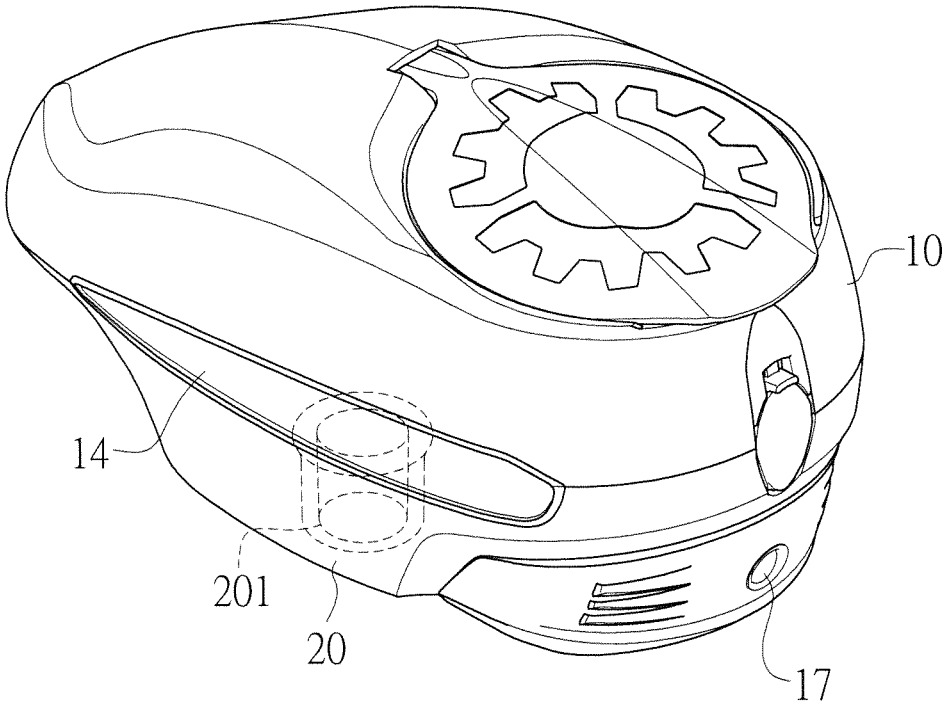
FIG. 7 is a top perspective view showing the fully assembled paintball loader of FIG. 1, according to principles of the present inventive concepts.

Referring now to FIG. 5, paintball guns may fire as fast as 30 to 40 paintballs per second, and the present inventive concepts further provide a device to let the player know the timing for supplying paintballs through the outlet 23 to the paintball gun. More particularly, a first sensor 15 may be located under the ramp 12. The first sensor 15 can be an infrared sensor. A second sensor 16 may be located at the outlet 23 of the base 2 so as to detect paintballs passing through the outlet 23. The second sensor 16 may also be an infrared sensor. The first and second sensors 15, 16 are preferably electrically connected to the control circuit 18. By detecting the paintballs in the chamber and passing through the outlet, the power source can be activated or shut off at appropriate times to move paintballs through the loader to the paintball gun.

Figure 3:
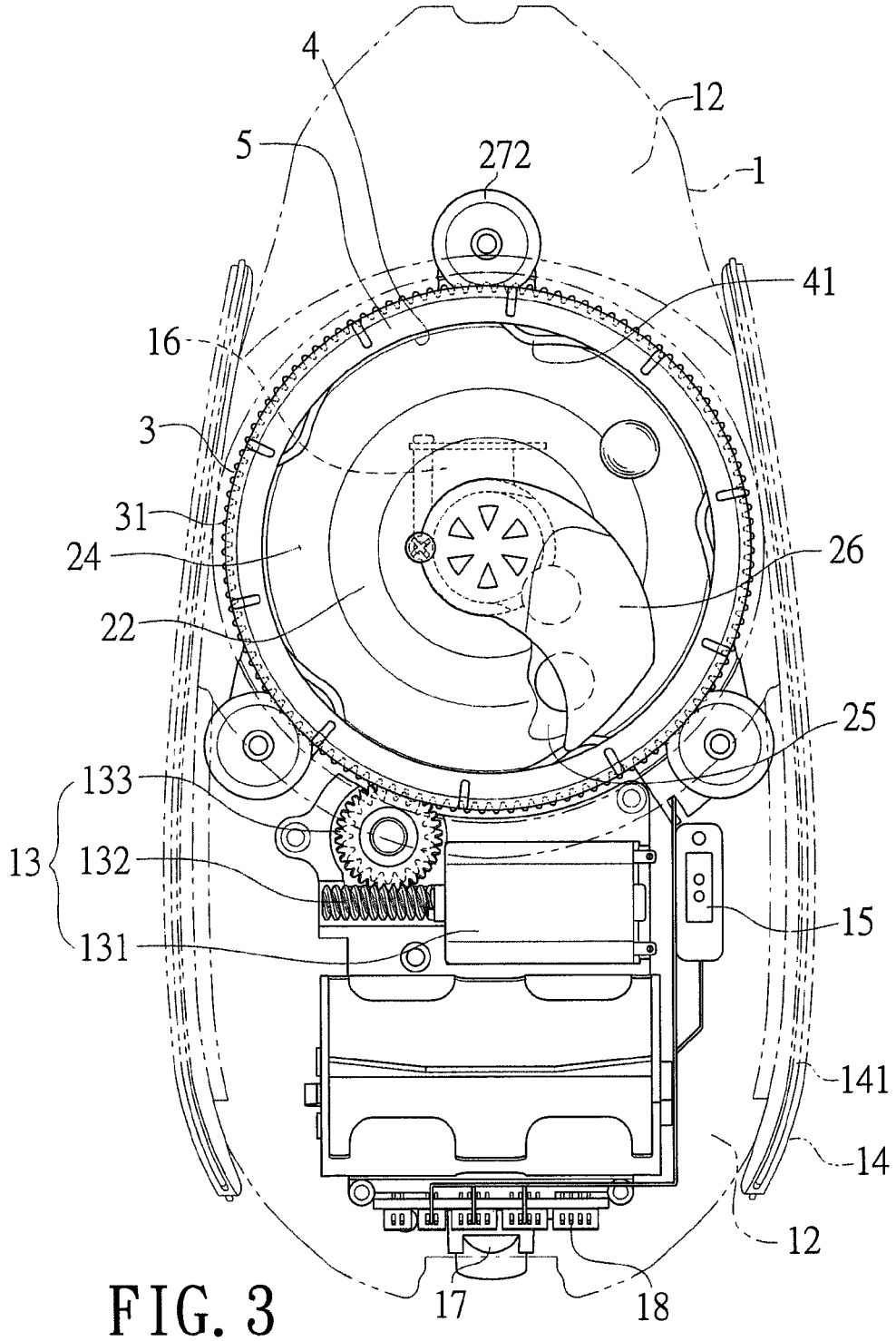
FIG. 3 is a transparent top view of the paintball loader of FIG. 1 provided to illustrate the relative positions of the parts of the paintball drive system of the paintball loader.
Figure 4:
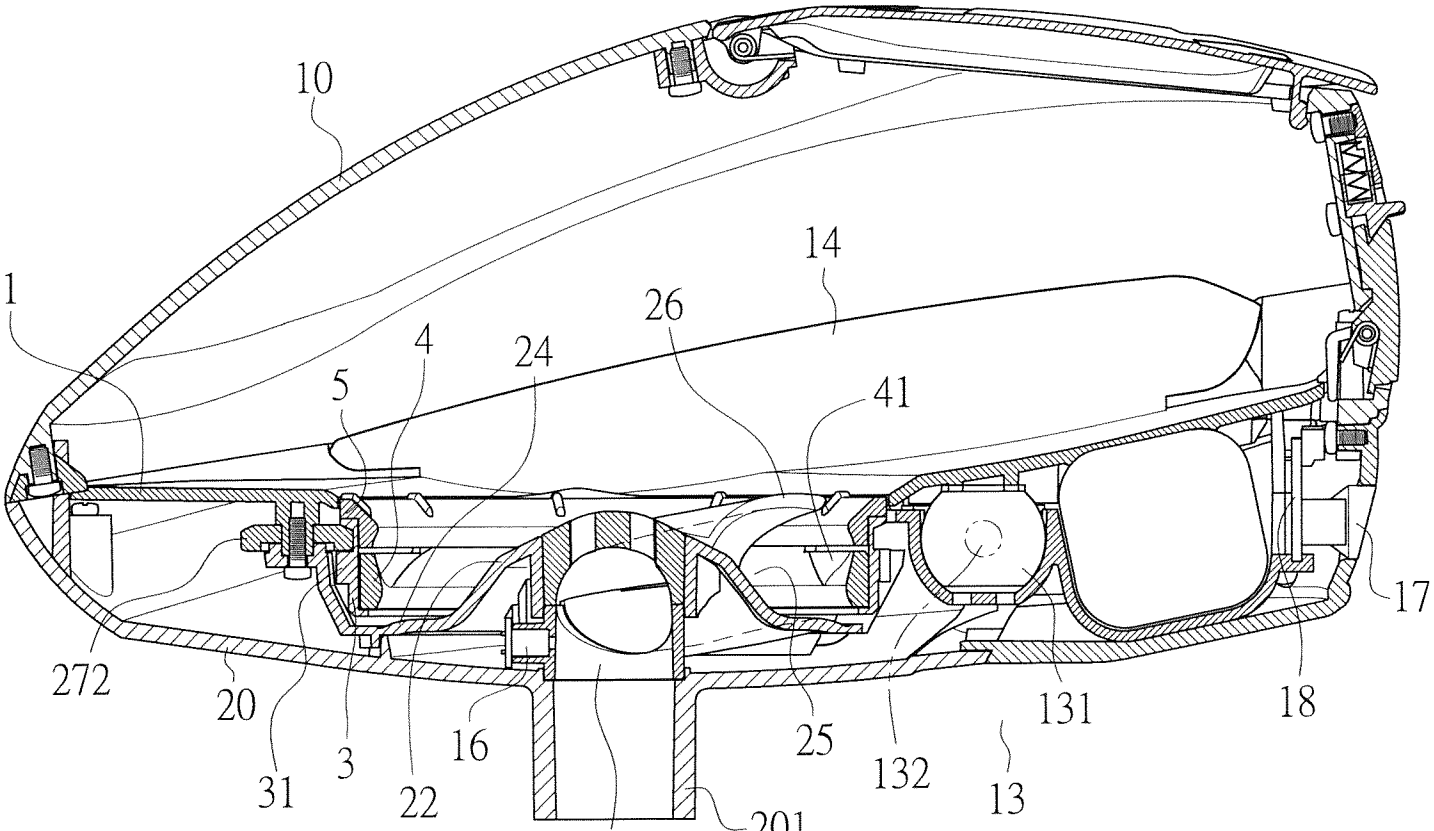
FIG. 4 is a side cross-sectional view of the paintball loader of FIG. 1.

Referring to FIGS. 3 to 5, when the second sensor 16 determines that no paintballs are in the outlet or that the paintballs are not moving, a signal from the first sensor 15 is also checked to determine the absence or presence of paintballs in the chamber. If paintballs are not moving through the outlet and no paintballs are present in the chamber, the power source 131 is shut off via the control circuit 18 and the paintball loader thereby stops the driving operation. When paintballs are loaded into the paintball loader, the first sensor 15 detects the paintballs and the power source 131 is activated via the control circuit 18. Accordingly, paintballs in the paintball loader enter into the entrance 25 via the paintball way 24 until the second sensor 16 detects the paintballs moving through the outlet 23.

Using the combination of signals from the first and second sensors 15, 16, the player may be informed of the status of the paintball loader. Furthermore, when a jam is detected (for instance when paintballs are detected in the chamber by the first sensor 15 and the second sensor 16 detects no paintball movement through the outlet 23), a signal is sent by the control circuit 18 to rotate the power source in reverse to clear the jam. Once the jam is cleared, the drive system operates to drive paintballs forward through the paintball way and the paintballs are again fed normally.

In addition to the components described above, a non-touch sensor 17 may be provided and connected to a main portion of the paintball loader. The non-touch sensor 17 may comprise a non-physical-touch sensor that does not need to be physically touched by an object to activate or shut off the electric power. The "ON" and "OFF" operation of the paintball loader may thereby be controlled by simply inserting a finger into an area where a power icon is marked, and movement of the finger can activate or shut off the power via the non-touch sensor 17.

The friction ring 4 can be made of multiple duraometer silicone to provide a surface that imparts a frictional force on the paintballs to roll them along the paintball way 24 of the base 2. By providing a frictional force to urge the paintballs along, rather than arms that catch and force paintball movement, the risk of breaking paintballs within the loader can be significantly reduced.

Using these principles, the paintballs can be smoothly and quickly urged and guided along the paintball way 24 of the base 2 toward the outlet 23 so that the paintball gun can shoot continuously without jamming.

According to still other principles of the inventive concepts, the connection between the first and second casings 10, 20 and the wings can be easily connected and disconnected quickly without the use of any tool.

According to still other principles, the player can be informed of an operational status of the loader (including if the chamber is empty) via LED indicators arranged on the paintball loader. The operational status can be determined using the combination of signals from the first and second sensors 15, 16. Based on information obtained from the sensors and indicated by the LEDs, the player can reload more efficiently.

The non-physical-touch sensor arranged on the surface of a main body of the paintball loader can also enable the player to activate or shut off the power quickly and easily while also ensuring that it is not inadvertently deactivated by accidental bumping or jarring.

While we have shown and described a preferred embodiment in accordance with the present inventive concepts, it should be clear to those skilled in the art that further embodiments may be made without departing from the scope of those concepts.

What is claimed is:

1. A loader configured to house a quantity of projectiles in a chamber and supply the quantity of projectiles from the chamber to an attached pneumatic gun when in operation, said loader comprising:

an outlet configured to supply projectiles from the chamber to the pneumatic gun when the loader is operatively connected to the pneumatic gun;

a non-rotating cone arranged above the outlet and having an opening in a side thereof to provide an entrance;

a way configured to direct projectiles into the outlet from the chamber through the entrance;

a cover connected to the non-rotating cone and having an arm that directs projectiles into the entrance;

a driving ring surrounding the non-rotating cone and configured to rotate around the non-rotating cone, wherein said driving ring is configured to urge projectiles from the chamber into the way and toward the outlet during operation of the loader.

2. The loader according to claim 1, said loader further comprising:

a top casing;

a bottom casing; and a drive system, said drive system comprising:

a floor board having a hole defined therethrough, said floor board including an inclined ramp extending from a periphery of the hole to provide a floor for a chamber arranged between the top casing and the bottom casing;

a power unit mounted to an end of the floor board;

a non-rotating base located at an underside of the floor board at a position corresponding to the hole, a room being formed in a top of the base and configured to contain a quantity of projectiles therein, said base including the non-rotating cone extending from the top of the base at a center portion of the room, wherein the outlet is defined below a center of the non-rotating cone, and the way is formed along a periphery of the non-rotating cone and communicates with the room, wherein the cover covers the outlet and is connected to the non-rotating cone, wherein the arm is configured to catch and direct paintballs into the way, and wherein the entrance communicates between the paintball way and the outlet;

a gear ring located in the room of the base and having teeth defined along an outside periphery thereof, the power unit engaged with the teeth to rotate the gear ring completely around the non-rotating cone;

a friction ring located at an inside of the gear ring and adapted to rotate around the non-rotating cone along with the gear ring, said friction ring having multiple protrusions extending toward but not contacting the non-rotating cone, said protrusions configured to push the paintballs in the room toward the entrance as the friction ring is rotated; and a driving ring connected to the gear ring and configured to rotate with the gear ring so as to move the projectiles toward the entrance using a frictional force between the driving ring and the projectiles.

3. The loader according to claim 2, wherein the multiple protrusions extend only a small portion of the distance between the friction ring and the non-rotating cone.

4. The loader according to claim 2, wherein the power unit has a power source and at least one transmission member engaging the teeth of the gear ring, wherein the power source has an output shaft configured to rotate the at least one transmission member to rotate the gear ring.

5. The loader according to claim 2, wherein a first sensor is located beneath the inclined ramp and is adapted to detect the absence or presence of projectiles in the chamber above the floor board.

6. The loader according to claim 4, wherein the power unit comprises a first gear having teeth engaged with teeth of a second gear, wherein the second gear has fewer teeth than the first, wherein the output shaft of the power source is engaged with the first gear, and wherein the teeth of the second gear are engaged with the teeth of the gear ring.

7. The loader according to claim 5, wherein a second sensor is located near the outlet of the base and is adapted to detect projectiles passing through the outlet.

8. The loader according to claim 7, wherein the first and second sensors are electrically connected to each other, and wherein the drive system is configured to use information received from both the first and second sensors to determine whether to activate or shut off the power source of the drive system.

9. The loader according to claim 2, further comprising a non-touch sensor located on the loader and electrically connected to the drive system, wherein the non-touch sensor is configured to activate or shut off electric power to the drive system in response to user actuation of the sensor by way of finger or hand movement in proximity to the non-touch sensor.

10. The loader according to claim 7, wherein the first and second sensors are infrared sensors.

11. A paintball drive system comprising:

an outlet configured to supply paintballs through the outlet;

a non-rotating cone arranged above the outlet and having an opening in a side thereof to provide an entrance;

a paintball way configured to direct paintballs into the outlet through the entrance;

a cover connected to the non-rotating cone and having an arm that directs paintballs into the entrance;

a driving ring surrounding the non-rotating cone and configured to rotate around the non-rotating cone, wherein said driving ring is configured to urge paintballs into the paintball way and toward the outlet during operation of the drive system.

12. The paintball drive system of claim 11, further comprising a friction ring surrounding and configured to rotate around the non-rotating cone, said friction ring comprising a plurality of protrusions extending only a portion of the distance from the friction ring toward the non-rotating cone, wherein said protrusions are configured to urge paintballs into the paintball way during operation of the drive system.

13. The paintball drive system of claim 11, further comprising a first sensor configured to detect the presence or absence of paintballs in a paintball chamber, and a second sensor configured to detect the presence or absence of paintballs in the outlet.

14. The paintball drive system of claim 13, wherein the paintball drive system is configured to use information received from both the first sensor and the second sensor to determine whether to actuate the drive system to drive rotation of the driving ring.

15. The paintball drive system of claim 14, wherein the drive system is configured to be actuated only when paintballs are detected in the chamber by the first sensor but no paintballs are detected in the outlet by the second sensor.

16. A paintball loader for use with a paintball gun, said paintball loader configured to supply a quantity of paintballs to the paintball gun through an outlet thereof when operatively connected to the paintball gun, said paintball loader comprising:

a housing comprising a chamber for containing a quantity of paintballs;

a floor board configured to provide a floor for the chamber;

a hole arranged through the floor board;

a drive system configured to receive paintballs through the hole and drive paintballs from the chamber toward an outlet of the paintball loader;

said drive system comprising:

a non-rotating cone arranged above the outlet and having an entrance formed through a side thereof, wherein the non-rotating cone is stationary with respect to the housing;

a driving ring surrounding the non-rotating cone and configured to rotate around the non-rotating cone to drive paintballs toward the entrance; and a power unit configured to drive the driving ring.

17. The paintball loader according to claim 16, further comprising a friction ring surrounding the non-rotating cone and configured to rotate with the driving ring, said friction ring comprising a plurality of protrusions extending towards, but not contacting, the non-rotating cone, wherein said protrusions are configured to urge paintballs toward the entrance when the friction ring is rotated.

18. The paintball loader according to claim 16, further comprising a paintball way providing a channel for directing paintballs into the entrance.

19. The paintball loader according to claim 18, further comprising a cover arranged on the non-rotating cone and providing an arm for directing paintballs into the paintball way.

20. The paintball loader according to claim 16, further comprising a first sensor and a second sensor, wherein the paintball loader is configured to actuate the power unit only when paintballs are detected in the chamber by the first sensor but no paintballs are detected in the outlet by the second sensor.

* * * * *